US006920981B2

(12) United States Patent
Lofgren et al.

(10) Patent No.: US 6,920,981 B2
(45) **Date of Patent: *Jul. 26, 2005**

(54) SUSPENSION PACKAGES AND SYSTEMS, CUSHIONING PANELS, AND METHODS OF USING SAME

(75) Inventors: Lewis C. Lofgren, Chicago, IL (US); Carmen Leigh Adams-Kraus, Schererville, IN (US)

(73) Assignee: Ade, Inc., Chicago, IL (US)

( * ) Notice: Subject to any disclaimer, the term of this patent is extended or adjusted under 35 U.S.C. 154(b) by 26 days.

This patent is subject to a terminal disclaimer.

(21) Appl. No.: 10/336,624

(22) Filed: Jan. 3, 2003

(65) Prior Publication Data

US 2004/0129601 A1 Jul. 8, 2004

(51) Int. Cl.[7] ..... B65D 81/07
(52) U.S. Cl. ..... 206/583; 206/594
(58) Field of Search ..... 206/583, 521, 206/594

(56) References Cited

U.S. PATENT DOCUMENTS

| | | | |
|---|---|---|---|
| 2,031,381 | A | 2/1936 | McCallum |
| 2,707,553 | A | 5/1955 | Yount |
| 2,802,565 | A | 8/1957 | Kabbash |
| 2,919,797 | A | 1/1960 | McCracken |
| 3,089,590 | A | 5/1963 | Mell |
| 3,424,306 | A | 1/1969 | Munck |
| 3,437,198 | A | 4/1969 | Van Saun et al. |
| 3,507,383 | A | 4/1970 | Rorer |
| 3,540,579 | A | 11/1970 | Hellstrom |
| 3,669,337 | A | 6/1972 | Struble |
| 3,718,275 | A | 2/1973 | Willinger |
| 3,891,090 | A | 6/1975 | Spiegel et al. |
| 3,905,474 | A | 9/1975 | Haibara |

(Continued)

FOREIGN PATENT DOCUMENTS

| | | |
|---|---|---|
| CA | 691904 | 4/1964 |
| DE | 299 21 203 U1 | 2/2000 |
| DE | 202 17 626 U1 | 1/2003 |
| JP | 49-59982 | 5/1974 |
| JP | 49-77087 | 7/1974 |
| JP | 50-88376 | 7/1975 |
| JP | 50-102778 | 8/1975 |
| JP | 50-107583 | 9/1975 |
| JP | 57-177969 | 11/1982 |
| JP | 3-100158 | 10/1991 |

OTHER PUBLICATIONS

Sealed Air Corporation Brochure, "Korrvu®: Suspension Packaging and Retention Packaging", Oct. 1999, 7 pages.

*Primary Examiner*—Mickey Yu
*Assistant Examiner*—Faye Francis
(74) *Attorney, Agent, or Firm*—Brinks Hofer Gilson & Lione; Gregory H. Zayia

(57) ABSTRACT

Suspension packages are described that include (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure mounted between the two end panels and extending over the first face of the product-supporting platform. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels. Suspension systems, cushioning panels, and methods of packaging products are also described.

19 Claims, 5 Drawing Sheets

U.S. PATENT DOCUMENTS

| | | | | |
|---|---|---|---|---|
| 3,966,046 | A | | 6/1976 | Deutschlander |
| 4,030,603 | A | | 6/1977 | Angell |
| 4,182,224 | A | | 1/1980 | Dutcher |
| 4,285,432 | A | | 8/1981 | de Villers et al. |
| 4,306,653 | A | | 12/1981 | Fales |
| 4,307,804 | A | | 12/1981 | Benham |
| 4,494,689 | A | | 1/1985 | Ilitch |
| 4,606,460 | A | | 8/1986 | Luray |
| 4,632,301 | A | | 12/1986 | Slack |
| 4,757,900 | A | | 7/1988 | Misset et al. |
| 4,852,743 | A | | 8/1989 | Ridgeway |
| 5,086,925 | A | | 2/1992 | Coalier et al. |
| 5,211,290 | A | | 5/1993 | Janus et al. |
| 5,251,760 | A | | 10/1993 | Smith et al. |
| 5,259,507 | A | | 11/1993 | Smith |
| 5,323,896 | A | | 6/1994 | Jones |
| 5,388,701 | A | | 2/1995 | Ridgeway |
| 5,579,917 | A | | 12/1996 | Lofgren et al. |
| 5,669,506 | A | | 9/1997 | Lofgren et al. |
| 5,678,695 | A | | 10/1997 | Ridgeway et al. |
| 5,722,541 | A | | 3/1998 | Lofgren et al. |
| 5,823,348 | A | | 10/1998 | Phillips et al. |
| 5,839,652 | A | | 11/1998 | Ben-Haim |
| 5,855,317 | A | | 1/1999 | Dalrymple |
| 5,894,932 | A | | 4/1999 | Harding et al. |
| 5,954,263 | A | | 9/1999 | Posson |
| 5,967,327 | A | | 10/1999 | Jones |
| 5,975,307 | A | | 11/1999 | Harding et al. |
| 6,010,006 | A | | 1/2000 | Ridgeway et al. |
| 6,119,863 | A | | 9/2000 | Lofgren et al. |
| 6,148,591 | A | | 11/2000 | Ridgeway et al. |
| 6,158,589 | A | * | 12/2000 | Smith et al. ..... 206/466 |
| 6,223,901 | B1 | | 5/2001 | Lofgren et al. |
| 6,311,844 | B1 | | 11/2001 | Ridgeway et al. |
| 6,467,624 | B1 | | 10/2002 | Lofgren et al. |
| 6,675,973 | B1 | | 1/2004 | McDonald et al. |
| 2001/0047950 | A1 | | 12/2001 | Beneroff et al. |
| 2004/0178113 | A1 | * | 9/2004 | Lofgren et al. ..... 206/583 |

* cited by examiner

FIG. 8
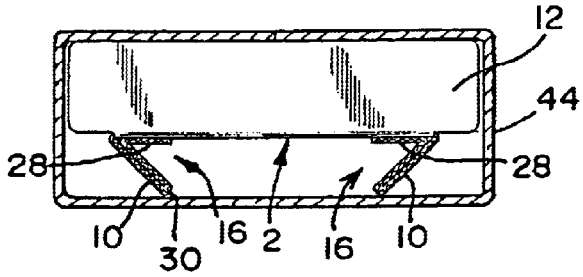
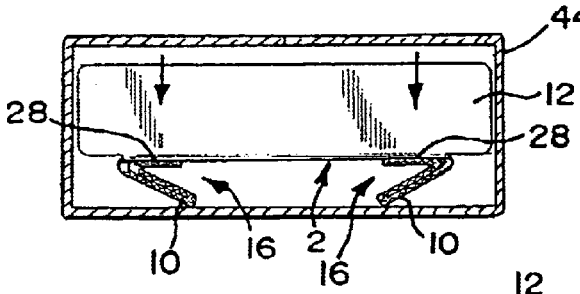
FIG. 9
FIG. 10
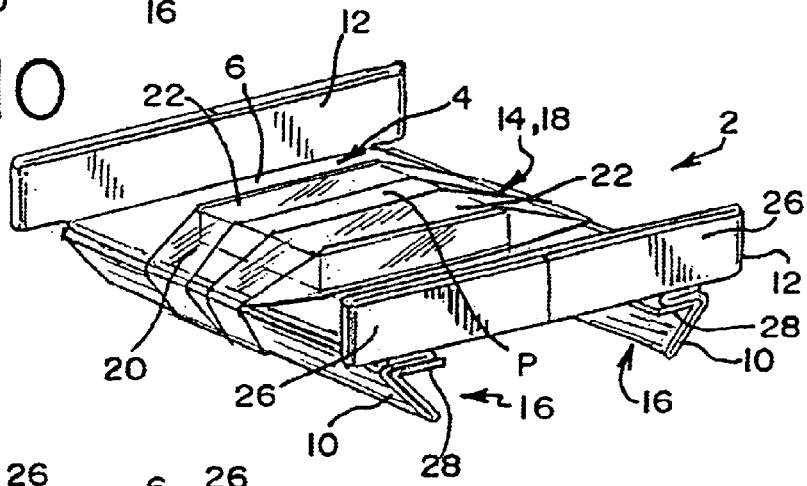
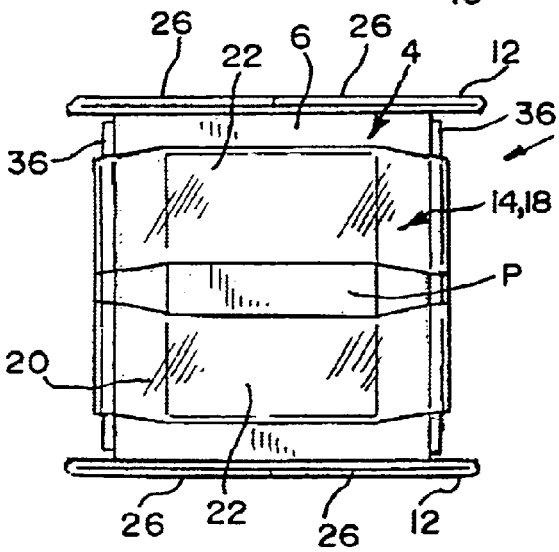
FIG. 11

SUSPENSION PACKAGES AND SYSTEMS, CUSHIONING PANELS, AND METHODS OF USING SAME

BACKGROUND

The present invention relates to suspension packages and, more particularly, to suspension packages for protecting products against shipping damage caused in transit.

Various designs of suspension packages have been proposed, including designs having a frame and a product-restraining hammock extending across a central opening in the frame. When the ends of the frame are folded to be perpendicular thereto in order to tension the hammock, a product may be suspended in the central opening. Such frame-containing suspension packages are described in U.S. Pat. Nos. 5,894,932 and 5,975,307 to Harding et al., both of which are assigned to the assignee of the present invention.

While frame-containing suspension packages of the type described above are well suited for a variety of applications, certain applications require more effective protection against product damage caused by bottom drops. In addition, products suspended in the central opening of frame-containing structures may undergo undesirable twisting during certain types of drops, which may diminish the ability of the structures to immobilize and protect the products. Furthermore, frame-containing structures are susceptible to buckling, which may likewise diminish the ability of the structures to immobilize and protect the products.

SUMMARY

The scope of the present invention is defined solely by the appended claims, and is not affected to any degree by the statements within this summary.

By way of introduction, a first suspension package embodying features of the present invention includes (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric enclosure mounted between the two end panels and extending over the first face of the product-supporting platform. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels and a biasing force acting to restore the end panels to ambient positions is established.

A second suspension package embodying features of the present invention includes (a) a product-supporting platform having first and second opposed faces; (b) two end panels, each pivotally connected to a respective end of the product-supporting platform; (c) two side panels, each pivotally connected to a respective side of the product-supporting platform; and (d) an elastomeric hammock comprising a polymeric film arranged in a C-fold, mounted between the two end panels and extending over the first face of the product-supporting platform. The product-supporting platform, the two end panels, and the two side panels are formed from a single sheet of corrugated paperboard. The two side panels are configured to pivot towards the first face of the product-supporting platform, such that the two side panels may be configured substantially perpendicular thereto. The two end panels are configured to pivot towards the second face of the product-supporting platform, thereby tensioning the elastomeric enclosure, such that acute angles may be formed between the second face of the product-supporting platform and each of the end panels.

A suspension system embodying features of the present invention includes (a) a suspension package of a type described above, and (b) an outer container for enclosing the suspension package.

A cushioning panel embodying features of the present invention includes (a) a platform having first and second opposed faces; (b) two end panels, each pivotally connected to a respective end of the platform; and (c) an elastomeric member mounted between the two end panels and extending over the first face of the platform. When the end panels are pivoted towards the second face of the platform, thereby tensioning the elastomeric member, acute angles may be formed between the second face of the platform and each of the end panels, such that a biasing force acting to restore the end panels to ambient positions is established.

A first method of packaging a product embodying features of the present invention includes (a) placing the product in a suspension package of a type described above; (b) tensioning the elastomeric enclosure of the suspension package, thereby substantially immobilizing the product; and (c) placing the suspension package in an outer container dimensioned such that the side panels of the suspension package are held in a configuration substantially perpendicular to the product-supporting platform.

A second method of packaging a product embodying features of the present invention includes (a) placing the product in a container having a plurality of walls; (b) tensioning a cushioning panel of a type described above; and (c) placing at least one tensioned cushioning panel between the product and at least one of the plurality of walls, such that the first face of the platform is adjacent to the product. The container is dimensioned such that the end panels of the cushioning panel are substantially prevented from returning to ambient positions.

BRIEF DESCRIPTION OF THE DRAWINGS

FIG. 8 shows a cross-sectional side view of the suspension system shown in FIG. 7 under activated conditions taken along the line A—A.

FIG. 9 shows a cross-sectional side view of the suspension system shown in FIG. 7 under bottom-out conditions.

FIG. 10 shows a perspective view of a second suspension package embodying features of the present invention.

FIG. 11 shows a top view of the suspension package shown in FIG. 10.

DETAILED DESCRIPTION OF THE PRESENTLY PREFERRED EMBODIMENTS

It has been discovered that effective protection of products against damage caused by bottom drops, front drops, back drops, and end drops can be achieved with a suspension package that provides a spring-like cushioning effect analogous to that provided by a leaf spring. The cushioning effect is controlled by an elastomeric film that has stretchability and memory (i.e., the ability to return to an original shape after deformation), which is suspended across the end panels of the suspension package. When a product is loaded in the suspension package, the suspension package may be activated simply by folding back the end panels, thereby tensioning the elastomeric film and imparting springiness to the end panels. If the suspension package containing the product is subjected to bottom drop, energy imparted to and/or forces acting upon the package during the drop will be absorbed through the spring-like cushioning effect at the end panels. If the suspension package containing the product is subjected to other types of drops, the elastomeric film absorbs energy and/or forces imparted during the drop by accommodating side-to-side and/or upward vertical motion of the product.

It has further been discovered that cushioning panels, which rely on similar spring-cushioning principles as the above-described suspension packages, may be placed around a product within an outer container to absorb shocks and attenuate effects of potentially damaging external shocks.

Throughout this description and in the appended claims, the following definitions are to be understood.

Figure 5:
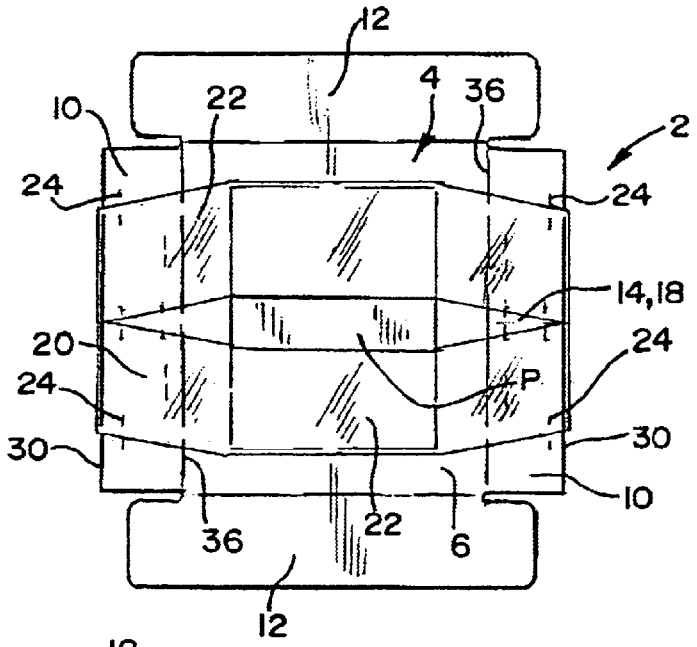
FIG. 5 shows a plan view from the top of the suspension package shown in FIGS. 1–4 under ambient conditions, wherein all elements of the suspension package are located in a single plane.
Figure 14:
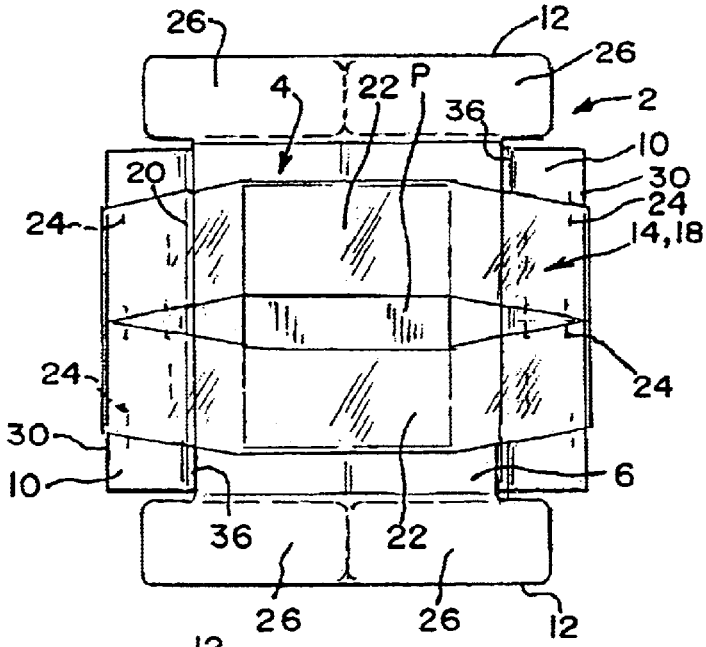
FIG. 14 shows a plan view from the top of the suspension package shown in FIGS. 10–13 under ambient conditions, wherein all elements of the suspension package are located in a single plane.

The phrase "ambient" or "under ambient conditions" refers to an un-activated (i.e., un-tensioned) state of an empty (i.e., devoid of product) or loaded (i.e., product-containing) suspension package, including but not limited to the substantially flat configurations that may be used during storage or transportation of empty suspension packages (i.e., all elements of the suspension package lie in substantially the same plane, as shown in FIGS. 5 and 14).

The phrase "activated" or "under activated conditions" refers to a tensioned state of an empty or loaded suspension package, which is achieved by folding back the end panels of the suspension package to form acute angles with the product-containing platform.

The phrase "bottom out" or "under bottom out conditions" refers to a maximum degree of compression that may be applied to a suspension package in an outer container subjected to a bottom drop.

The presently preferred embodiments described herein may possess one or more advantages relative to conventional product packaging, which may include but are but not limited to: ease of use; reduced cost of materials and fabrication; ability to control performance levels through design variation (e.g., length of hinged end panels, number of folds in hinged panels, type of scoring in folds, type of corrugated material, type of elastomeric film, length of elastomeric film, folded width of elastomeric film, etc.); ability to store and/or ship suspension packages in substantially flat configurations, thereby minimizing storage space and shipping costs; reduction in the deflection space required for effective protection against bottom drops; reduction in overall package size; improved protection against end drops; improved consistency of front and back drops through reduction in product twisting in product restraint; improved immobilization of product within product restraint through tighter stretching of elastomeric enclosure around product; minimization of buckling, creasing, and cracking of suspension package; facile immobilization of product within elastomeric enclosure when suspension package is outside container; and increased ease of removal of activated suspension package from outer container.

A first series of presently preferred suspension packages embodying features of the present invention is shown in FIGS. 1–9. For the purpose of illustrating a context in which presently preferred embodiments of the present invention may be practiced, a representative product P is depicted in several of the drawing figures. The suspension package 2 includes (a) a product-supporting platform 4 having first and second opposed faces, 6 and 8, respectively; (b) two end panels 10, each pivotally connected to a respective end of the product-supporting platform 4; (c) two side panels 12, each pivotally connected to a respective side of the product-supporting platform 4; and (d) an elastomeric enclosure 14 mounted between the two end panels 10 and extending over the first face 6 of the product-supporting platform 4.

The two side panels 12 are configured to pivot towards the first face 6 of the product-supporting platform 4, such that the two side panels 12 may be configured substantially perpendicular thereto. In alternative embodiments (not shown), the side panels 12 are fixedly connected (rather than pivotally connected) to the respective sides of the product-supporting platform 4. In additional alternative embodiments, the side panels 12 are replaced with one or more spacing elements (not shown), which may be pivotally or fixedly connected to the product-supporting platform 4. The spacing elements may include segmented portions of side panel 12 (e.g., one or more rectangular strips used in place of the contiguous rectangular element comprising side panels 12) or other regular or irregular geometric shapes.

The two end-panels 10 are configured to pivot towards the second face 8 of the product-supporting platform 4, thereby stretching the elastomeric enclosure 14, such that acute angles 16 may be formed between the second face 8 of the product-supporting platform 4 and each of the end panels 10. The springiness of an activated end panel 10 is determined by a combination of factors including the length of the end panels 10, the length of the elastomeric enclosure 14, and the folded width of the elastomeric enclosure 14. The elastomeric enclosure 14, preferably selected to have good stretch and recovery characteristics, fulfills at least two roles—namely, that of securing a product P and that of applying spring-like tension to end panels 10.

While not wishing to be bound by a particular theory, nor intending to limit in any measure the scope of the appended claims or their equivalents, it is presently believed that products secured in suspension packages embodying features of the present invention are protected against damage caused by top and edge drops primarily through the action of the elastomeric enclosure 14, and against damage caused by bottom drops primarily through the action of the spring-cushioning effect described above.

Presently preferred designs for achieving the above-mentioned spring-like cushioning effect involve establishing angles that are sufficiently large to prevent the end panels 10 from contacting the second face 8 of the product-supporting platform 4 (e.g., such as in FIGS. 9 and 17 described below), yet not so large as to eliminate the spring-like action of the end panels 10 against a surface (e.g., the bottom of an outer container) on which they rest.

The magnitude of acute angles 16 is not limited. However, it is preferred that acute angles 16 be sufficiently small (e.g., not greater than about 50 degrees, more preferably not greater than about 45 degrees) so that when the suspension package 2 is enclosed in an outer container, there will be a reduced tendency for the end panels 10 to expand to a 90 degree perpendicular orientation with concomitant reduction in desired spring-like cushioning ability. It is especially preferred that the magnitude of acute angles 16 be such that the they will not spring to 90 degrees even after multiple compression and recovery cycles (e.g., bottom drops). Furthermore, it is preferred that acute angles 16 be sufficiently large (e.g., at least 15 degrees, more preferably at least 20 degrees) so that a product P contained in an activated suspension package 2 subjected to a bottom drop will be substantially undamaged (i.e., energy and/or forces imparted by the drop will be substantially absorbed by the spring-like cushioning effect).

Suspension packages embodying features of the present invention may be formed from any suitable material, including but not limited to paperboard, corrugated paperboard, plastics, fiberboard, metals, and the like, and combinations thereof. Corrugated paperboard (e.g., 275 pound single wall, kraft, C-flute board, 200 pound double wall, 275 or 300 pound double wall, kraft, B/C-flute board, etc.) is a presently preferred material. Preferably, all portions of suspension packages embodying features of the present invention, except for the elastomeric enclosure, are formed from a single sheet of material. For example, each of the two end panels and the two side panels may be formed from a single sheet of corrugated paperboard that is simply folded along designated fold, crease, or score lines to provide the desired design of suspension package. Such an assembly process minimizes cost and simplifies fabrication. However, alternative embodiments are contemplated in which various pieces of the suspension package are fabricated separately and then assembled to provide a completed suspension package.

The elastomeric enclosure 14, depicted in several of the drawings as a hammock 18 for purposes of illustration, includes any mechanism capable of securing a product, including but not limited to hammocks (i.e., materials suspended across distances, which are attached to supports at opposite ends thereof) and nets (i.e., meshed fabrics which may include a drawstring mechanism for contracting an interior space). Hammocks are presently preferred elastomeric enclosures.

All manner of retention mechanisms have been contemplated for use with elastomeric enclosures embodying features of the present invention. Throughout this description and in the appended claims, the term "enclosure" is to be understood in a very broad sense as referring to any product retention mechanism, regardless of whether the complete product or only a portion thereof is enclosed in or physically contacts the retention mechanism. In certain embodiments such as the above-described hammock 18, elastomeric enclosures preferably include interior regions capable of substantially enclosing a product (e.g., enveloping the product on at least a portion of each of its sides). However, such interior regions and such a substantial enclosure are not required.

The key characteristics of elastomeric enclosures embodying features of the present invention are that they (a) be stretchable so as to absorb energy and/or forces imparted during drops, and (b) exhibit a tendency to return to their original configurations (i.e., have "memory"). Accordingly, elastomeric enclosures may be formed from any suitable elastomeric material, including but not limited to polymeric films, spandex cloths, and the like. Polymeric films such as polyurethane and polyethylene are especially preferred materials at present. Polyurethane is an especially preferred polymeric film inasmuch as it exhibits both good stretch and good recovery characteristics. Polyethylene, which exhibits good stretch but not as good recovery, is still a suitable polymeric film in certain applications. In accordance with certain embodiments of the present invention, increased protection may be afforded to particularly sensitive products by using a film capable of more elastic deformation than might be required for less sensitive products in combination with an outer container that is larger than might be required for less sensitive products.

As best seen in FIGS. 1, 2, 4, 5, and 7, the hammock 18 includes a lower portion 20 and at least two upper portions 22 that define a product insertion and removal region. This representative and non-limiting arrangement, known as a C-fold, provides a film that is C-shaped in cross section, and which may be used to substantially enclose a product packaged therein. The film may include product retention regions, such as welded dots and/or knurled patterns formed by sonic welding, to further restrict movement of a product restrained therein.

Figure 1:
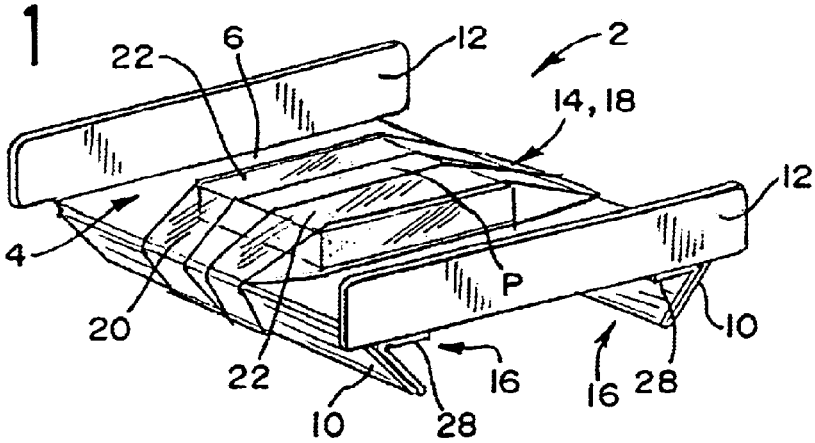
FIG. 1 shows a perspective view of a first suspension package embodying features of the present invention.
Figure 2:
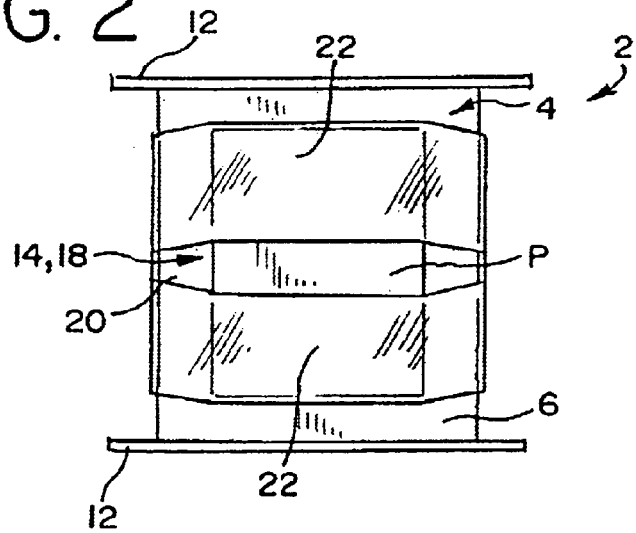
FIG. 2 shows a top view of the suspension package shown in FIG. 1.
Figure 3:
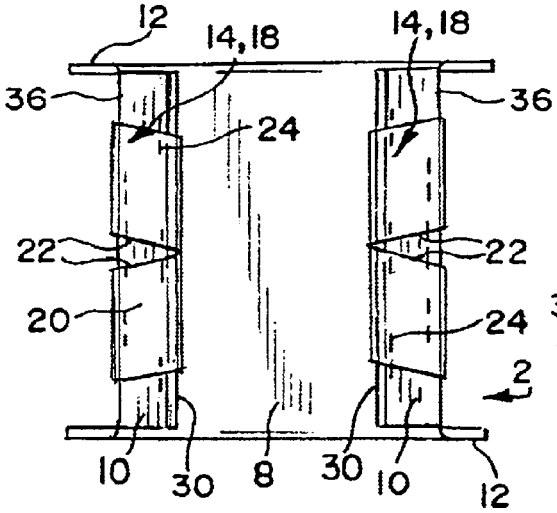
FIG. 3 shows a bottom view of the suspension package shown in FIGS. 1 and 2.
Figure 4:
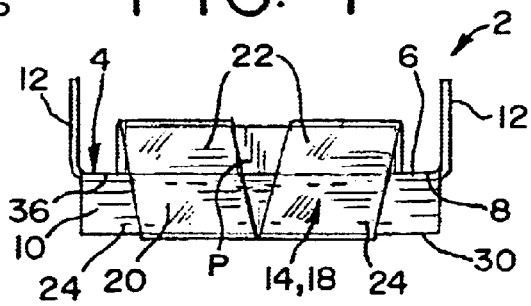
FIG. 4 shows a side view of the suspension package shown in FIGS. 1–3.
Figure 12:
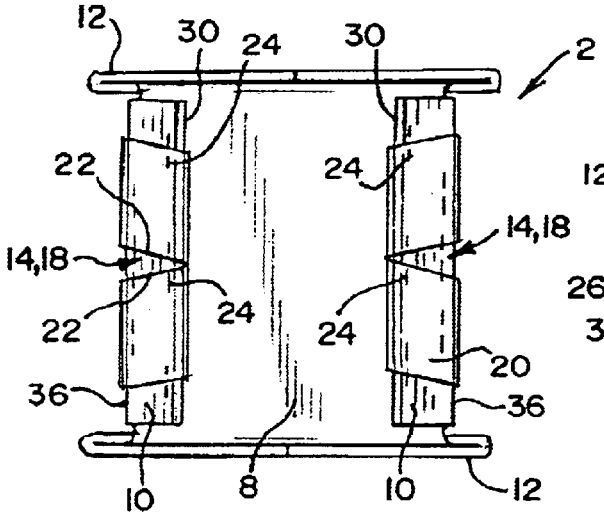
FIG. 12 shows a bottom view of the suspension package shown in FIGS. 10 and 11.
Figure 13:
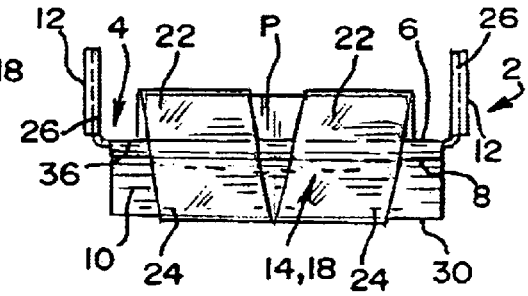
FIG. 13 shows a side view of the suspension package shown in FIGS. 10–12.

The polymeric film forming elastomeric enclosures 14 may be attached to each of the two end panels 10 by any suitable fastener, including but not limited to staples, adhesives, tapes, stitches, and combinations thereof. Staples 24 are presently preferred fasteners that may also be used to conveniently secure folded portions of the suspension package. Although the points of attachment of fasteners to the elastomeric enclosure 14 is not limited, it is preferred that the fasteners, for example staples 24, be introduced at opposite ends of elastomeric enclosure 14, more preferably at opposite points defining the furthest distance between the two ends of elastomeric enclosure 14, in order to provide for maximum stretchability of elastomeric enclosure 14. As best shown in FIGS. 3 and 12, it is especially preferred that the staples 24 be introduced on the face of end panels 10 that is adjacent to the second face 8 of product-supporting platform 4. More preferably, the staples 24 are introduced near an outer edge 30 of end panels 10, on the faces of end panels 10 that are adjacent to the second face 8 of product-supporting platform 4.

Preferably, suspension packages embodying features of the present invention further include two reinforcing flaps 28, each pivotally connected to an inner edge 36 of the end panels 10, such that the reinforcing flaps 28 are configured to contact the second face 8 of the product-supporting platform 4 when the elastomeric enclosure 14 is tensioned. Reinforcing flaps 28 serve to strengthen the edges of the product-supporting platform 4.

Figure 6:
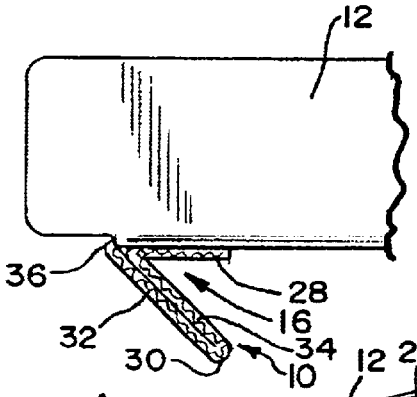
FIG. 6 shows a detailed view of the acute angle formed between the product-supporting platform and an end panel of the suspension package shown in FIGS. 1–5
Figure 7:
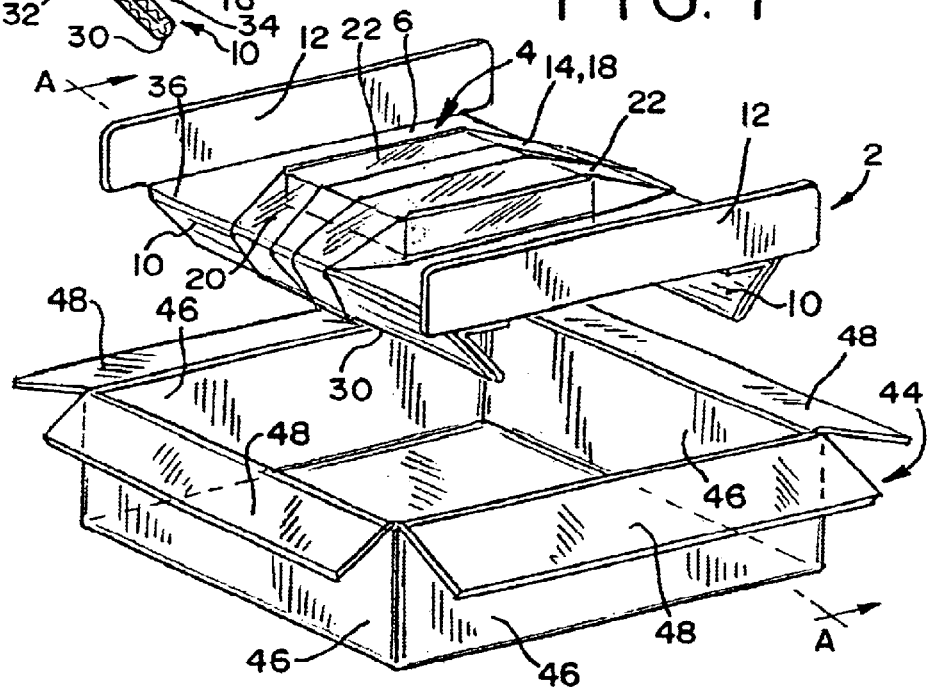
FIG. 7 shows an exploded perspective view of a first suspension system embodying features of the present invention.

In the first series of presently preferred suspension packages shown in FIGS. 1–9, the product-supporting platform 4, the two end panels 10, the two side panels 12, and the two reinforcing flaps 28 are formed from a single sheet of material, with the product-supporting platform 4, the two side panels 12, and the two reinforcing flaps 28 having a single-wall thickness and the two end panels 10 having a double-wall thickness (i.e., the corrugated paperboard forming the end panels 10 has been folded back upon itself). As best shown in FIG. 6, the single sheet of material is folded along the outer edge 30 of the end panel 10, such that first and second opposed layers—32 and 34, respectively—of the double-wall are formed.

Figure 15:
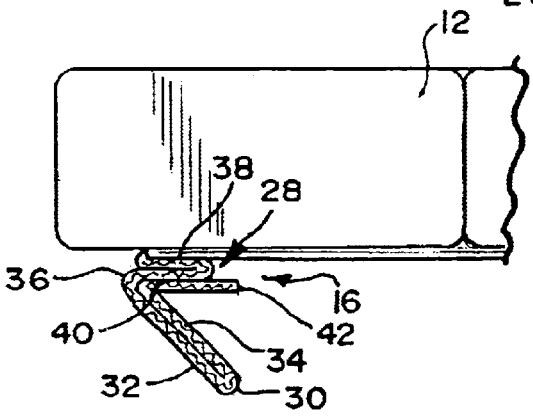
FIG. 15 shows a detailed view of the acute angle formed between the product-supporting platform and an end panel of the suspension package shown in FIGS. 10–14.

A second series of presently preferred suspension packages embodying features of the present invention is shown in FIGS. 10–17. This series differs from the suspension packages shown in FIGS. 1–9 in the folding pattern used to form the end panels 10 and reinforcing flaps 28. The folding pattern used to form the suspension packages shown in FIGS. 10–17 further reinforces the edges of the product-supporting platform 4. As in the first series, the product-supporting platform 4, the two end panels 10, the two side panels 12, and the two reinforcing flaps 28 are formed from a single sheet of material. However, in the embodiments shown in FIGS. 10–17, the product-supporting platform 4 and the two side panels 12 have a single-wall thickness, the two end panels 10 have a double-wall thickness, and the two reinforcing flaps 28,have a triple-wall thickness. As best shown in FIG. 15, the single sheet of material is folded along an inner edge 36 and an outer edge 30 of the end panel 10, such that first and second opposed layers—32 and 34, respectively—of the double-wall are formed, and first, second, and third layers—38, 40, and 42, respectively—of the triple-wall are formed.

Suspension packages embodying features of the present invention may further include side panels 12 having double-wall thickness. Such double-wall thick side panels may be formed starting from double-length single-wall side panels 12, the end portions 26 of which are folded back toward the middle of side panels 12 and secured (e.g., with tape, staples, etc.), as best shown in FIG. 14. The end portions 26 of side panels 12 are pivotally connected thereto unless secured as noted above. The double-wall thickness imparted to side panels 12 may provide additional protection against damage caused by certain types of drops.

Suspension systems embodying features of the present invention are shown in FIGS. 7, 8, 9,16, and 17 and include (a) a suspension package of a type described hereinabove, and (b) an outer container 44 for enclosing the suspension package. Preferably, the outer container 44 contains a plurality of fixed panels 46 and at least one pivotally connected flap 48 defining an insertion and removal region. Preferably, the outer container 44 is a top-loading box.

It is preferred that the outer container 44 be dimensioned such that when the elastomeric enclosure 14 of the suspension package 2 is tensioned and the suspension package 2 is enclosed by the outer container 44 under activated conditions, the side panels 12 of the suspension package 2 are prevented from pivoting towards a configuration substantially coplanar with the product-supporting platform (i.e., are prevented from returning to the ambient condition depicted in FIGS. 5 and 14). Moreover, it is preferred that the outer container 44 be dimensioned such that the side panels 12 are held in a configuration substantially perpendicular to the product-supporting platform.

Figure 16:
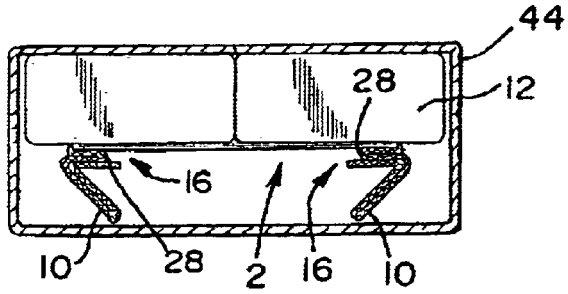
FIG. 16 shows a cross-sectional side view of a second suspension system embodying features of the present invention under activated conditions.

Preferred dimensions of the outer container 44 are such that the activated height of the suspension package 2 enclosed therein (i.e., the height of a product-containing suspension package 2 measured from the bottom edge of the end panels 10 to the top edge of side panels 12) is slightly greater (i.e., less than about ten percent) than an internal height of the outer container 44 when the latter is open. Furthermore, it is preferred that the outer container 44 be dimensioned such that the activated height of the suspension package 2 enclosed therein is substantially equal to the internal height of the outer container 44 when the latter is closed, as shown in FIGS. 8 and 16. Thus, a pressure is exerted against at least one interior surface of the closed outer container 44 by the spring-cushioning action of the activated suspension package 2 enclosed therein.

Figure 17:
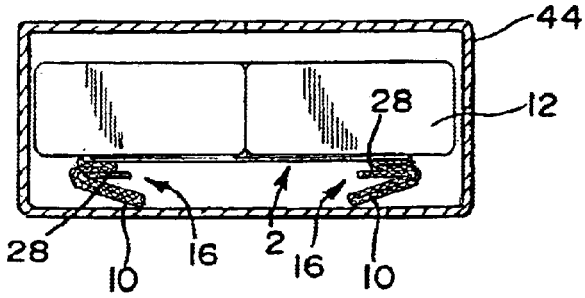
FIG. 17 a cross-sectional side view of the suspension system shown in FIG. 16 under bottom-out conditions.

If a suspension system embodying features of the present invention is subjected to an excessive bottom drop force, a point of maximum compression of the suspension package 2 within the outer container 44 may result, as shown in FIGS. 9 and 17. Under such bottom out conditions, the product has an increased susceptibility to damage. Thus, it is preferred that the degree of spring-cushioning effect that is provided by the elastomeric film under activated conditions be sufficient to prevent or at least significantly reduce the frequency of bottom out events.

In general, the dimensions of the outer container 44 are selected in view of the packaging requirements for a specific product (e.g., amount of deflection space required to protect a product, degree of elasticity of polymeric film, requisite degree of spring-cushioning effect needed to protect against bottom drops, etc.).

Figure 18:
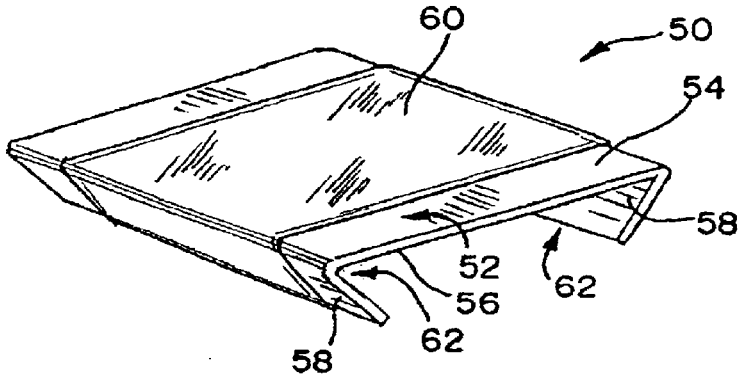
FIG. 18 shows a perspective view of a cushioning panel embodying features of the present invention.

A cushioning panel 50 embodying features of the present invention is shown in FIG. 18 and includes (a) a platform 52 having first and second opposed faces, 54 and 56, respectively; (b) two end panels 58, each pivotally connected to a respective end of the platform 52; and (c) an elastomeric member 60 mounted between the two end panels 58 and extending over the first face 54 of the platform 52. The end panels 58 may be pivoted towards the second face 56 of the platform 52, thereby stretching the elastomeric member 60. Acute angles 62 may be formed between the second face 56 of the platform 52 and each of the end panels 58, such that a biasing force acting to restore the end panels 58 to their ambient positions is established.

Preferably, the elastomeric member 60 is slightly (i.e., less than about ten percent) shorter than the distance between the ends of the end panels 58, which may be multi-folded. When the hinged end panels 58 are rotated towards the second face 56 of the platform 52, an outward tension is exerted by the elastomeric member 60, which biases the end panels 58 towards their ambient positions. Thus, when cushioning panels 50 embodying features of the present invention are placed in spatially restricted regions that prevent the end panels 58 from returning to their ambient positions, the cushioning panels 50 will function as spring-like devices when energy and/or forces are imparted thereto. For example, activated cushioning panels 50 positioned around a product within an outer container will act as shock absorbers by deflecting and then recovering in response to a force, thus attenuating the effects of potentially damaging external shocks. Cushioning panels 50 embodying features of the present invention may be used as the sole form of product protection, or in conjunction with one or more other protective systems.

Elastomeric members 60 for use in accordance with cushioning panels 50 embodying features of the present invention may be formed from any suitable elastomeric material, including but not limited to polymeric films, rubber, spandex cloth, and the like. Polymeric films such as polyurethane and polyethylene, such as may be used to form the elastomeric hammocks 18 described above, are preferred materials at present, with polyurethane being especially preferred. All manner of geometries, widths, thicknesses, and the like are contemplated for the elastomeric members 60 embodying features of the present invention.

A first series of methods for packaging products in accordance with the present invention includes (a) placing a product in any of the suspension packages embodying features of the present invention described hereinabove; (b) tensioning the elastomeric enclosure of the suspension package, thereby substantially immobilizing the product; and (c) placing the suspension package in an outer container that is dimensioned such that the side panels of the suspension package are held in a configuration substantially perpendicular to the product-supporting platform.

A second series of methods for packaging products in accordance with the present invention includes (a) placing a product in a container having a plurality of walls; (b) tensioning a cushioning panel embodying features of the present invention; and (c) placing at least one tensioned cushioning panel between the product and at least one of the plurality of walls, such that the first face of the platform is adjacent to the product. Preferably, the container is dimensioned such that the end panels of the cushioning panel are prevented from returning to ambient positions.

The foregoing detailed description and accompanying drawings have been provided by way of explanation and illustration, and are not intended to limit the scope of the appended claims. Many variations in the presently preferred embodiments illustrated herein will be obvious to one of ordinary skill in the art (e.g., alternative shapes and relative dimensions of the suspension packages, elastomeric enclosures, etc.), and remain within the scope of the appended claims and their equivalents.

What is claimed is:

1. A suspension package comprising:

a product-supporting platform having first and second opposed faces;

two end panels, each pivotally connected to a respective end of the product-supporting platform;

two reinforcing flaps, each pivotally connected to an inner edge of the end panels, wherein the reinforcing flaps are configured to contact the second face of the product-supporting platform;

two side panels, each pivotally connected to a respective side of the product-supporting platform; and an elastomeric enclosure mounted between the two end panels and extending over the first face of the product-supporting platform; wherein the two side panels are configured to pivot towards the first face of the product-supporting platform and to be configured substantially perpendicular thereto; and the two end panel are configured to pivot between an un-tensioned state and a tensioned state, wherein in the tensioned state, acute angles are configured to form between the second face of the product-supporting platform and each of the end panels, and wherein the end panels are configured to provide a spring action against a surface in contact therewith.

2. The invention of claim 1 wherein the acute angles are not greater than fifty degrees.

3. The invention of claim 1 wherein each of the two end panels and the two side panels is connected to the product-supporting platform along a score line.

4. The invention of claim 1 wherein the product-supporting platform, the two end panels, and the two side panels are formed from a single sheet of material.

5. The invention of claim 4 wherein the material is selected from the group consisting of paperboard, corrugated paperboard, plastics, and fiberboard.

6. The invention of claim 4 wherein the material is corrugated paperboard.

7. The invention of claim 1 wherein the elastomeric enclosures comprises a polymeric film.

8. The invention of claim 1 wherein the elastomeric enclosure is selected from the group consisting of a hammock and a net.

9. The invention of claim 1 wherein the elastomeric enclosure is a hammock comprising a lower portion and at least two upper portions, and wherein the at least two upper portions define a product insertion and removal region.

10. The invention of claim 9 wherein the hammock comprises a polymeric film.

11. The invention of claim 10 wherein the polymeric film is arranged in a C-fold.

12. The invention of claim 10 wherein the polymeric film is attached to each of the two end panels by a fastener selected from the group consisting of staples, adhesives, stitches, and combinations thereof.

13. The invention of claim 1 wherein the product-supporting platform, the two end panels, the two side panels, and the two reinforcing flaps are formed from a single sheet of material.

14. The invention of claim 13 wherein the product-supporting platform, the two side panels, and the two reinforcing flaps are single-wall and the two end panels are double-wall.

15. The invention of claim 14 wherein the single sheet of material is folded along outer edges of the end panels, such that first and second opposed layers of the double-wall are formed.

16. The invention of claim 13 wherein the product-supporting platform and the two side panels are single-wall, wherein the two end panels are double-wall, and wherein the two reinforcing flaps are triple-wall.

17. The invention of claim 16 wherein the single sheet of material is folded along inner and outer edges of the end panels, such that first and second opposed layers of the double-wall are formed, and first, second, and third layers of the triple-wall are formed.

18. The invention of claim 13 wherein the product-supporting platform is single-wall, wherein the two side panels and the two end panels are double-wall, and wherein the two reinforcing flaps are triple-wall.

19. A cushioning panel comprising:

a platform having first and second opposed faces;

two end panels, each pivotally connected to a respective end of the platform, and pivotable between an un-tensioned state and a tensioned state;

two reiforcing flaps, each pivotally connected to an inner edge of the end panels, wherein the reinforcing flaps are configured to contact the second face of the platform; and an elastomeric member mounted between the two end panels and extending over the first face of the platform; wherein in the tensioned state, acute angle, are configured to form the second face of the platform and each of the end panels, such that a biasing force acting to restore the end panels to ambient positions is established, and wherein the end panels are configured to provide a spring action against a surface in contact therewith.

* * * * *